US010822557B2

(12) United States Patent
Sarkar et al.

(10) Patent No.: US 10,822,557 B2
(45) Date of Patent: Nov. 3, 2020

(54) PROCESS FOR PRODUCTION OF PETROCHEMICALS FROM CRACKED STREAMS

(71) Applicant: INDIAN OIL CORPORATION LIMITED, Maharashtra (IN)

(72) Inventors: Mainak Sarkar, Faridabad (IN); Nayan Das, Faridabad (IN); Ganesh Vitthalrao Butley, Faridabad (IN); Sarvesh Kumar, Faridabad (IN); Rama Kant Yadav, Faridabad (IN); Pastagia Kashyapkumar Mahindra, Faridabad (IN); Madhusudan Sau, Faridabad (IN); Debasis Bhattacharyya, Faridabad (IN); Sanjiv Kumar Mazumdar, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 16/299,008

(22) Filed: Mar. 11, 2019

(65) Prior Publication Data

US 2019/0276753 A1 Sep. 12, 2019

(30) Foreign Application Priority Data

Mar. 9, 2018 (IN) ..... 201821008684

(51) Int. Cl.

| | |
|---|---|
| ***C10G 9/00*** | (2006.01) |
| ***C10G 47/00*** | (2006.01) |
| ***C10G 65/12*** | (2006.01) |
| ***C10G 69/02*** | (2006.01) |
| ***C10G 69/06*** | (2006.01) |
| ***C10G 7/00*** | (2006.01) |

(52) U.S. Cl.

CPC ..... *C10G 69/06* (2013.01); *C10G 7/00* (2013.01); *C10G 9/00* (2013.01); *C10G 47/00* (2013.01); *C10G 65/12* (2013.01); *C10G 2300/1044* (2013.01); *C10G 2300/1048* (2013.01); *C10G 2300/1096* (2013.01); *C10G 2300/305* (2013.01); *C10G 2300/307* (2013.01); *C10G 2300/4006* (2013.01); *C10G 2300/4012* (2013.01); *C10G 2300/4018* (2013.01); *C10G 2400/02* (2013.01); *C10G 2400/04* (2013.01)

(58) Field of Classification Search

CPC ..... C10G 9/00; C10G 47/00; C10G 65/12; C10G 69/02; C10G 69/06; C10G 2300/301; C10G 2300/305; C10G 2300/307; C10G 2400/02; C10G 2400/04

See application file for complete search history.

(56) References Cited

U.S. PATENT DOCUMENTS

| | | | | |
|---|---|---|---|---|
| 8,142,645 | B2 | 3/2012 | Zhou et al. | |
| 8,404,103 | B2 | 3/2013 | Dziabala et al. | |
| 9,644,155 | B2 | 5/2017 | Butley et al. | |
| 2015/0267130 | A1* | 9/2015 | Butley ..... | C10G 65/12 568/321 |

* cited by examiner

*Primary Examiner* — Randy Boyer

(74) *Attorney, Agent, or Firm* — Maschoff Brennan

(57) ABSTRACT

The present invention relates to a process for production of High-Octane Gasoline blending component, Heavy Naphtha with high aromatic content and High Cetane Diesel from high aromatic middle distillate range boiling streams obtained from catalytic as well as thermal cracker units.

2 Claims, 2 Drawing Sheets

PROCESS FOR PRODUCTION OF PETROCHEMICALS FROM CRACKED STREAMS

FIELD OF THE INVENTION

This invention relates to a novel process for converting the middle distillate boiling range streams obtained from catalytic as well as thermal cracker units to (i) High-Octane gasoline blending stream, (ii) Heavy Naphtha with high-aromatics content, feedstock for BTX production and (iii) High CN ultra-low sulphur diesel (ULSD).

BACKGROUND OF THE INVENTION

The Middle distillate range stream from Fluid Catalytic Cracking (FCC) Units and Resid Fluid Catalytic Cracking (RFCC) Units are called Light Cycle Oil (LCO). In typical refinery configuration the LCO stream is routed to refinery diesel pool after reducing sulphur through high pressure hydrotreating. Currently in most refinery configuration, LCO is the second highest contributor to the refinery diesel pool. However, because of its property, LCO only adds volume to the pool without contributing anything to its property; in fact, it deteriorates some of the important pool properties such as Cetane number (CN) and density. Although, LCO is in the diesel boiling range, with T95 point at about 360° C., however, due to high aromatics content, Hydrotreating of LCO at high pressure only reduces the sulphur content, but improvement in Cetane Number (CN) is not significant and in most cases it is 10-15 unit lower compared to that required for meeting EURO-VI diesel specification. Further the Specific gravity of the hydrotreated LCO is in the range of 0.87 to 0.89, whereas for EURO-VI diesel Specific Gravity requirement is only 0.845 (max). Therefore, Hydrotreating LCO at very high pressure (90-105 barg $H_2$ partial pressure) and converting the aromatics to naphthenes with only moderate improvement in CN is inefficient utilization of costly hydrogen.

Alternate approach for utilizing the LCO stream is to convert it to feedstock for aromatic complex for production of valuable chemical viz. Benzene, Toluene and Xylene (BTX). In this process the di and tri aromatics present in the LCO steam is selectively converted to Alkyl benzene by saturating the second and the third ring respectively and then opening the saturated ring by mild hydrocracking. In this route, the chemical potential of the LCO stream is utilized to its fullest extent. However, in this route, moderate hydrogen pressure (25-75 bar g) needs to be maintained for maximizing the Alkyl benzene concentration in the product stream by protecting the mono-aromatics already present in the LCO stream and those forms during the course of reaction. Therefore, the CN of the unconverted stream generated in the process is considerable low compared to high pressure hydrotreating unit. Since the unconverted stream is in the diesel boiling range and also the sulphur is below 10 ppmw hence it can be blended in the refinery diesel pool, however, only because of low CN and high density this stream requires further hydroprocessing.

The present invention is directed towards improving the CN and lowering the density of the unconverted stream so that this stream can be directly routed to the diesel pool avoiding further hydrotreatment.

Review of Related Art

High aromatic content in the middle distillate streams of any thermal or catalytic cracker unit is the major hurdle to incorporate these streams into the refiner diesel pool. On hydrotreating these streams, the multi ring aromatics get converted to mono-aromatics but with fused naphthenic ring (i.e. naphtho benzene). The saturation of first ring or second ring occurs at very low hydrogen partial pressure; however, saturation of last aromatic rings requires very high hydrogen partial pressure. Even on saturating all the aromatic rings the CN improvement is very insignificant compared to the hydrogen consumption. Therefore, efforts are being made for profitably utilization of these types of streams. Some of the previous works closely related to the present invention have been discussed in brief.

U.S. Pat. No. 8,404,103 discloses about the technique for converting high aromatic stream into ultra low sulfur gasoline and diesel by optimizing hydrotreater severity and allowing nitrogen slippage up 20 ppmw into hydrocracker feed for enhancing the RON of the gasoline. This document claimed to have a gasoline cut with RON value of at least 85 and a diesel cut with less than 10 ppmw of sulfur, however, no claim had been made on the CN of the diesel.

Bing Zhou et al in U.S. Pat. No. 8,142,645 discloses method for conversion of poly-nuclear aromatics of cycle oil and pyrolysis fuel oil into higher value mono-aromatic compounds, such as benzene, toluene, xylenes and ethyl benzene. In this document, the inventors disclosed about catalyst complexes where catalytic metal is in the center surrounded by organic ligands. During hydrocracking procedure, the organic ligand preserves one of the aromatic rings of the poly-nuclear aromatic compounds while the catalytic metal breaks the other aromatic rings thereby yielding a mono-aromatic compound.

OBJECTIVES OF THE INVENTION

The main objective of the present invention is to provide a process, where the middle distillate range boiling streams originating from the catalytic crackers are utilized to generate (i) High-Octane Gasoline blending component and (ii) Heavy Naphtha with high-aromatic content suitable for producing BTX.

Another objective of the present invention, in particular, discloses about utilization of middle distillate originating from thermal cracking units in the same process in appropriate ratio for boosting the CN of the unconverted stream produced.

Still another objective of the present invention is to improve the CN and lower the density of the unconverted stream so that this stream can be directly routed to the diesel pool avoiding further hydrotreatment.

SUMMARY OF THE INVENTION

Based on the cracking methodology and the feed characteristic, the properties of the middle distillate range boiling streams obtained from different types of cracking units vary widely. For example, the aromatics content in middle distillates obtained from catalytic cracking units (FCC or RFCC) is very high compared to that obtained for thermal cracker units such (Delayed Coker or Visbreaker). There are also a lot of variations in other physical and chemical properties.

The present invention discloses a novel integrated process for converting middle distillate boiling range streams of catalytic as well as thermal cracker units to (i) High-Octane gasoline blending stream, (ii) Heavy Naphtha with high-aromatics content, feedstock for BTX production and (iii)

High CN ultra-low sulphur diesel (ULSD) by utilizing the potential of each stream to its fullest extent.

Accordingly, present invention provides a process for production of High-Octane Gasoline blending component, Heavy Naphtha with high aromatic content and High Cetane Diesel from high aromatic middle distillate range boiling streams, the process comprising:

(a) subjecting a combined feed-1 and feed-2 to a hydrotreating step at a predetermined pressure to obtain a first effluent having removed heteroatom, wherein the pressure is capable of saturating of only one ring of multi-ring aromatics;

(b) subjecting the first effluent to a hydrocracking step to obtain a second effluent, wherein the hydrocracking is operated for selective opening of saturated ring of the multi-ring aromatics and hydrocracking of long aliphatic side chains of mono-aromatic molecule present in the first effluent;

(c) fractionating the second effluent into a CUT-1, a CUT-2 and a CUT-3; wherein: the CUT-1 is having boiling point between 35 and 95° C., which is High-Octane gasoline blending component having octane number greater than 88, the Cut-2 is having a boiling point between 95 and 210° C., which is Heavy Naphtha with high aromatic content and the Cut-3 is having boiling point above 210° C. which is High Cetane Diesel having cetane number more than 50 and comprising an enhanced concentration of saturates, wherein the feed-1 is middle distillate boiling range stream obtained from catalytic cracking unit, and feed-2 is middle distillate boiling range stream obtained from thermal cracking unit and the feed 2 having thermally cracked unit is present in the combined feed is in the range of 5 to 30 wt %.

In one of the feature of the present invention, the thermal cracking unit is selected from Delayed Coker Unit (DCU), and other units where cracking reaction occurs in absence of cracking catalyst system, wherein the other unit is selected from visbreaker gas oil, pyrolysis oil, and thermally cracked bio-source.

In another feature of the present invention, the combined Feed for the process is having at least 30 wt % two or more ring aromatics content therein and boiling between 140 to 430° C.

In yet another feature of the present invention, the combined feed is the mixture of feed-1 and feed-2 in the ratio from 95:5 to 70:30 by mass.

In still another feature of the present invention the hydrotreating step is carried out at a pressure of 25 to 100 bar g and temperature of 320 to 410° C. and at a LHSV of 0.5 to 1.5 $h^{-1}$.

In yet another feature of the present invention, the hydrocracking step is carried out at a same pressure as that of hydrotreating which is between 25 to 100 bar g, and at a temperature of 350 to 450° C. and at a LHSV of 0.2 to 2.0 $h^{-1}$.

In yet another feature of the present invention, the hydrocracking step is carried out at conversion level that gives combined yield of first two products and the first product is high octane gasoline and the second product is high aromatic naphtha above 30 wt %.

In yet another feature of the present invention, the Cut-2, Heavy Naphtha is having aromatics and alkylated monoaromatics concentration more than 50 wt %.

In yet another feature of the present invention, the High Cetane Diesel is having cetane number more than 51.

In one of the feature of the present invention, the above process further comprising recycling a part of the high cetane diesel of step (c) to step (a).

Present invention also provides a process for production of ultra low sulfur High-Octane Gasoline blending component, Heavy Naphtha with high aromatic content and High Cetane Diesel from high aromatic middle distillate range boiling streams, the process comprising:

(a) subjecting a combined feed-1 and feed-2 and recycled part of high cetane diesel to a hydrotreating step at a predetermined pressure to obtain a first effluent having removed heteroatom, wherein the pressure is capable of saturating of only one ring of multi-ring aromatics;

(b) subjecting the first effluent to a hydrocracking step to obtain a second effluent, wherein the hydrocracking is operated for selective opening of saturated ring of the multi-ring aromatics and hydrocracking of long aliphatic side chains of mono-aromatic molecule present in the first effluent;

(c) fractionating the second effluent into a CUT-1, a CUT-2 and a CUT-3; wherein:

the CUT-1 is having boiling point between 35 and 95° C., which is High-Octane gasoline blending component having octane number greater than 88, the Cut-2 is having a boiling point between 95 and 210° C., which is Heavy Naphtha with high aromatic content and the Cut-3 is having boiling point above 210° C. which is High Cetane Diesel having cetane number more than 50 and comprising an enhanced concentration of saturates, (d) recycling a part of the high cetane diesel of step (c) to step (a), wherein the feed-1 is middle distillate boiling range stream obtained from catalytic cracking unit, and feed-2 is middle distillate boiling range stream obtained from thermal cracking unit and the feed 2 having thermally cracked unit is present in the combined feed is in the range of 5 to 30 wt % and the combined feed is having at least 30 wt % of two or more ring aromatics content therein and boiling between 140 to 430° C.

DETAILED DESCRIPTION OF THE INVENTION

Figure 1:
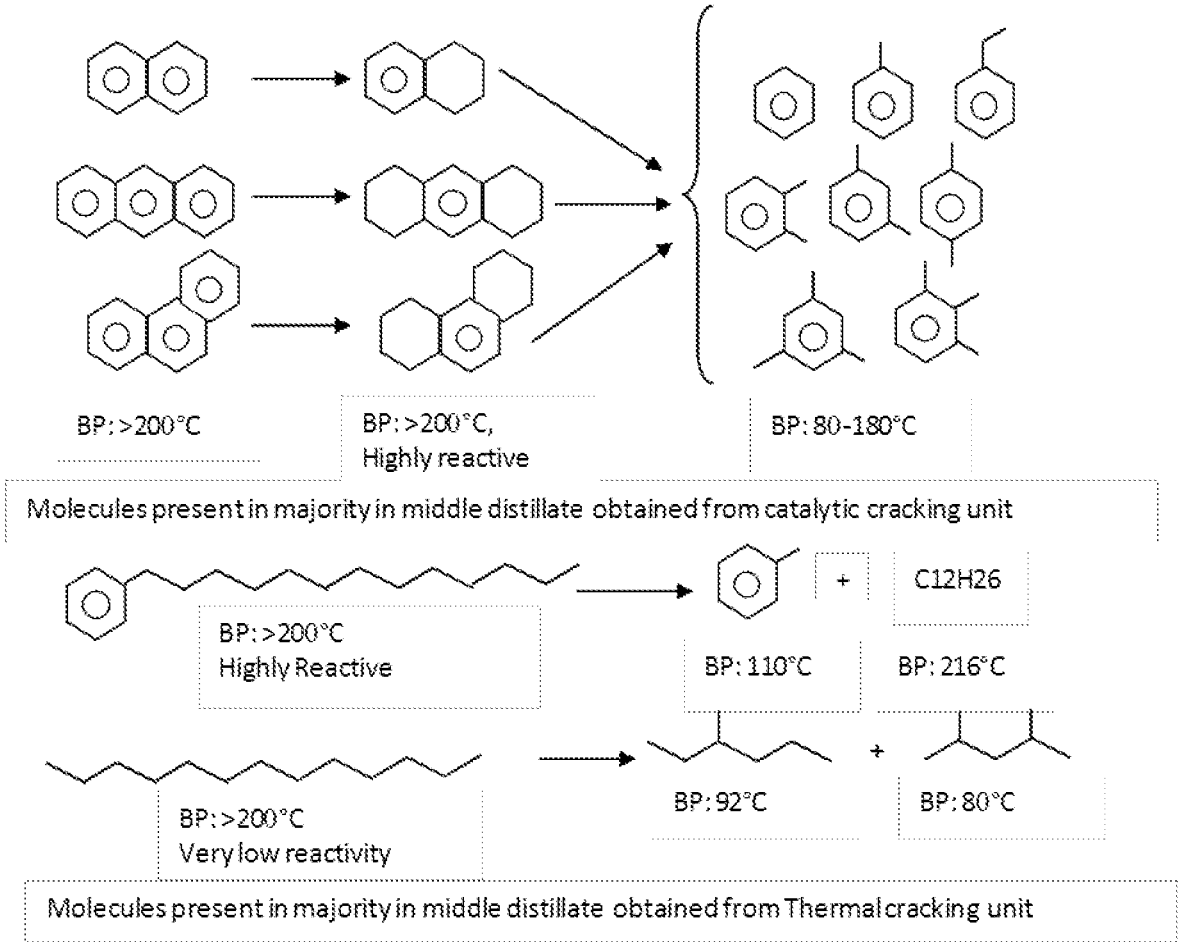
FIG. 1 illustrates reaction involved in the process.
Figure 2:
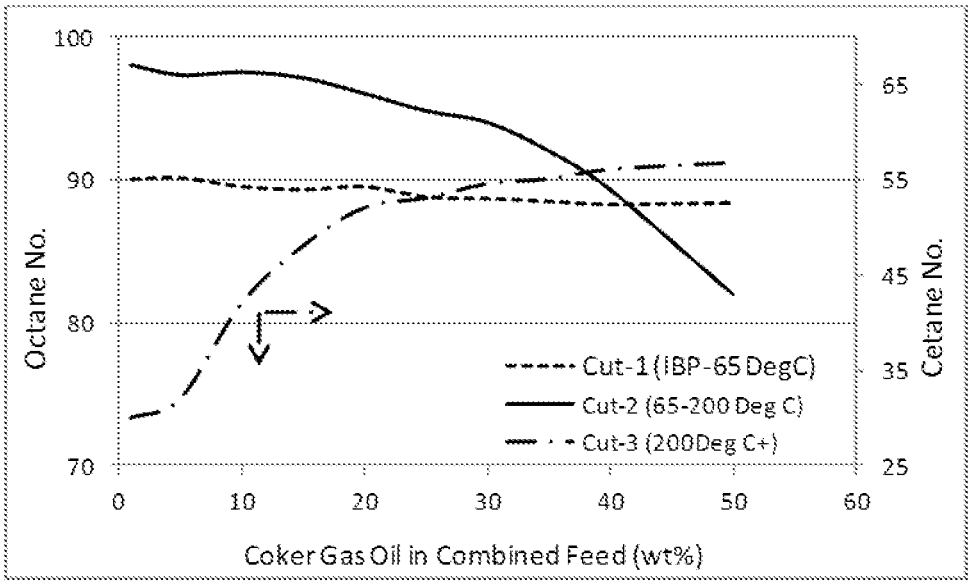
FIG. 2 illustrates change in RON of Cut-1, Cut-2 & Cetane number of Cut-3.

Accordingly the present invention discloses a process, where the middle distillate range boiling streams originating from the catalytic crackers are utilized to generate (i) High-Octane Gasoline blending component and (ii) Heavy Naphtha with high-aromatic content suitable for producing BTX. In the same embodiment, the present invention also discloses about utilization of middle distillate originating from thermal cracking units in the same process in appropriate ratio for boosting the CN of the unconverted stream produced.

In U.S. Pat. No. 9,644,155, which is incorporated herein as reference in its entirety, the inventors have described an integrated process for the production of high octane gasoline, high aromatic naphtha and high cetane diesel. The diesel stream (CUT-3) obtained by the process disclosed in U.S. Pat. No. 9,644,155 has cetane number of at least 42 units, and hence, there is a need of further oxidation step for said cut to further improve the cetane number. The inventors of the preset invention have invented a process whereby this additional step of oxidation is avoided, still achieving a high cetane number in the diesel stream.

In another feature, the present invention discloses that the High-Octane Gasoline blending component refers to the hydrocarbon stream generated in the process is boiling between C5 and 95° C. Preferably the hydrocarbon stream generated in the process is boiling between C5 and 80° C. More preferably, the hydrocarbon stream generated in the process is boiling between C5 and 65° C. The research octane number (RON) of this stream is preferred between 80 and 95 units. More preferably the RON of this stream is between 85 and 95 units. Most preferably the RON of this stream is between 88 and 92 units. The Heavy Naphtha with high aromatic content is referred to hydrocarbon stream generated in the process and boiling between 95 and 210° C. Preferably the Heavy Naphtha with high aromatic content is between 85 and 200° C. Most preferably the Heavy Naphtha with high aromatic content is between 65 and 180° C. The aromatic content in this stream is preferably between 50 and 80 wt %. Most preferably the aromatic content in this stream is between 65 and 75 wt %. The RON of this stream is between 90 and 105 unit. Most preferably the RON of this stream is between 95 and 100 units. The Unconverted Stream is referred to the hydrocarbon stream generated in this process with Initial Boiling Point (IBP) more than, 210° C. Preferably the unconverted stream is referred to the hydrocarbon stream generated in this process with Initial Boiling Point (IBP) more than, 200° C. Most preferably the unconverted stream is referred to the hydrocarbon stream generated in this process with Initial Boiling Point (IBP) more than, 180° C. The CN of this stream is above 50 units. Most preferably the CN of this stream is above 51 units. The other properties of this stream are also suitable for direct blending in the refinery diesel pool.

In one of the feature, the present invention discloses that the Sulphur content of all the streams generated in this process is below 10 ppmw.

In one feature, the present invention discloses that middle distillate boiling range streams originating from the catalytic cracker units are high in aromatic content compared to those originating from thermal cracking units. The middle distillate boiling range stream obtained from Catalytic Cracking Unit and Thermal Cracking Units are also referred as catalytically cracked and thermally cracked middle distillate respectively.

The middle distillate boiling range stream, generally known as Light Cycle Oil (LCO) obtained from catalytic cracking unit viz. FCC and RFCC are high in aromatic content. The total aromatics content in such stream generally varies from 50 to 90 wt % depending on the operating severity of the unit. In high severity cracking units viz. RFCC the aromatics content in LCO stream is very high compared to low severity FCC unit. Further, the FCC units of those process in which hydrotreated VGO contains less aromatics in LCO stream compared to those process of untreated VGO. The total aromatics in LCO is constitute of about 20-30 wt % mono-aromatics, 60-70 wt % di-aromatics and about 5-10 wt % polycyclic aromatics hydrocarbon (PAH). The PAH rarely contain more than three ring aromatics.

The middle distillate boiling range stream obtained from thermal cracking units viz. delayed Coker (DCU) contains about 20-50 wt % aromatics and the rest is saturated. The Coker middle distillate may also contains olefins but not more than 5-6 wt %. The aromatics in Coker middle distillate, comprises of about 10-20 wt % mono-aromatics, 5-15 wt % di-aromatics and about 5-15 wt % polycyclic aromatics hydrocarbon (PAH). The PAH may contains up to five ring aromatics.

The detail characterization of middle distillates obtained from catalytic and thermal cracking units are given in Table-I.

The process for converting the middle distillate range boiling streams originating from catalytic and thermal cracking units to High-Octane gasoline blending component, Heavy Naphtha with high aromatics content and High CN ULSD blending component comprises of the following steps:

(a) The hydrocarbon feed stream preferably boiling between 140 and 390° C., more preferably between 180 and 410° C. and most preferably between 200 and 430° C. is subjected to hydrotreatment over any hydrotreating catalyst system known in the art. The hydrotreating reactor called Reactor-1 (R-1) is a normal trickle bed plug flow reactor with down flow configuration as known in the common art of hydroprocessing.

(b) The effluent from the R-1 is then subjected to a second reactor (R-2) system containing bed of hydrocracking catalyst suitable for ring opening at mild operating condition.

(c) The effluent from the R-2 is fractionated to generate three cuts Cut-1: High-Octane gasoline blending component, Cut-2: Heavy Naphtha with high aromatics content and Cut-3: High CN ULSD boiling above boiling above 215° C. Preferably the High CN ULSD boiling above boiling above 205° C. Most preferred the High CN ULSD boiling above boiling above 190° C.

In one of the features, the present invention discloses that the hydrocarbon feed for the process comprises of middle distillate range boiling streams preferably boiling between 140 to 430° C. More preferably, the middle distillate range boiling streams is between 180 to 410° C. Most preferably the middle distillate range boiling streams is between 200 to 430° C. originated from both catalytic cracking units viz. FCCU and RFCCU and thermal cracking units viz. Delayed Coker unit (DCU). The middle distillate range boiling streams of Catalytic Cracking units are also referred as Light cycle oil (LCO) and Thermal Cracking unit is called Coker Gas Oil (CGO). The thermal cracking unit does not limit to only DCU but all other units where cracking reaction occurs in absence of catalyst system, viz. visbreaker unit, Naphtha cracker heavy residue etc. In the same feature the present invention also discloses that the fraction of middle distillate originating from the Thermally Cracked unit in the total feed is preferable between 5 to 30 wt %. More preferably the Thermally Cracked unit in the total feed is between 10 to 20 wt %. Most preferably the Thermally Cracked unit in the total feed is between 12 to 18 wt %.

In yet another feature, the present invention discloses that thermally cracked middle distillate in the feed is decisive for improving the CN of Cut-3, however, beyond a critical concentration, the aromatics concentration of the Heavy Naphtha i.e. yield of Cut-2 starts reducing and the RON deteriorates. The effect of thermally cracked middle distillate in the feed is illustrated in FIG.-1. The effect of thermally cracked middle distillate in the product properties is attributed to its distinct chemical composition compared to middle distillate generating from Catalytic Crackers. In the thermally cracked middle distillates, the aromatic content is only between 20 to 50 wt % and the rest are saturated hydrocarbons. Further, the saturated hydrocarbon is mostly comprises of straight chain aliphatic hydrocarbons. The aromatics composition of the thermally cracked middle distillates is also very distinct, the mono-aromatics are the major contributor to the total aromatics content, however, contribution of PAH is also significant, in some cases contribution of PAH is more than di-aromatic hydrocarbons. On the contrary the di-aromatics are the major contributor to the total aromatics content in catalytically cracked middle distillate such as LCO. On further analysis of the thermally cracked middle distillates, it is observed that the mono-aromatics present in this stream is associated with long straight chain aliphatic hydrocarbon, which also contributes significantly towards its CN. Because of higher concentration of straight chain aliphatic hydrocarbons and at the same time presence of mono-aromatics with long straight chain aliphatic hydrocarbon substitutes, the CN of thermally cracked middle distillates is also decent compared to catalytically cracked middle distillate. Due to distinct compositional difference the thermally cracked middle distillates contributes towards enhancing CN of the unconverted stream (Cut-3) whereas the catalytically cracked middle distillate contributes towards the enhancing the aromatics content and RON of the Heavy Naphtha (Cut-2).

It is well documented fact that the reactivity of the hydrocarbon molecules in hydrocracker is in reverse order compared to that in catalytic cracker. In hydrocracker the paraffinic molecules (straight chain aliphatic hydrocarbon) are the least reactive whereas the aromatic molecules are the most reactive. The reactivity of iso-paraffins and naphthene molecules are in between paraffinic and aromatic species. Because of this specific reactivity order the straight chain aliphatic hydrocarbons present in the thermally cracked middle distillates are least converted in the R-2 reactor and contribute to towards enhancing CN of the unconverted stream (Cut-3), whereas the aromatics present catalytic and thermal cracked middle distillate streams boiling above 210° C. and preferably above 200° C. and most preferably above 180° C. are easily converted to benzenes and Alkyl benzenes preferably boiling below, 210° C. and preferably 200° C. and most preferably 180° C.

It is further established fact that the order of hydrocracker reaction is between 1.4 and 2.0. The order of reaction is depend on the rate of reaction and defined by following equation:

$$\text{Rate of Reaction}=kC^n$$

Where, k is rate constant, C is concentration of reactants and n is the order of reaction.

For hydrocracking reaction the value of n is in between 1.4 and 2.0. Therefore, if the concentration of aliphatic hydrocarbon increase beyond the critical concentration, in this case 30 wt % the cracking of aliphatic hydrocarbons will be significant enough to deteriorate the RON of cut-2. Even though, the cetane number of Cut-3 will increase, however, at the cost of Cut-2 properties. In other word, any reaction with order greater than 1 the rate of reaction is directly proportional to the concentration of the reactant in the reaction mixture. Hence, if the concentration of straight chain aliphatic hydrocarbon is increased in the reaction mixture beyond a critical concentration the rate of cracking of these molecules also becomes significant enough and starts reducing the aromatic concentration of Cut-2 and thereby deteriorates the RON of Heavy Naphtha. The critical concentration in this case is 5-30 wt % of Coker gasoil in LCO. Therefore, it is very essential to maintain the ratio of catalytic to thermally cracked components in the feed stream.

In another feature, it is further disclosed that the proportion of thermal cracked middle distillate in the feed can be further increased if the IBP of this stream is maintained above, 200° C., preferably 230° C. and most preferably 250° C. The proportions of aromatics are more in heavier fraction of middle distillate compared to lighter fraction.

In yet another feature the operating parameters for R-1 and R-2 reactors are disclosed. The primary function of R-1 is hydrotreatment of feed for removing metals, heteroatoms (sulphur and nitrogen) and converting di-/tri-aromatics and PAH to mono-aromatics or more precisely to benzo-cylo-paraffin molecules. Nitrogen compounds are poison for the R-2 catalyst, hence N-slippage at R-1 reactor outlet is maintained below 50 ppmw. More preferably, the N-slippage at R-1 reactor outlet is maintained below 30 ppmw. Most preferably, the N-slippage at R-1 reactor outlet is maintained below 20 ppmw. The temperature in R-1 is maintained between 320 and 410° C. More preferably the temperature in R-1 is maintained between 340 and 300° C. Most preferably the temperature in R-1 is maintained between 350 and 390° C. The Linear Hourly Space Velocity (LHSV) is maintained between 0.5 and 1.5. Most preferably the Linear Hourly Space Velocity (LHSV) is maintained between 0.7 and 1.2. The pressure for this process is very critical. The preferred pressure for this process is between 25 and 100 bar g. More preferably, the pressure for this process is between 35 and 90 bar g. Most preferably, the pressure for this process is between 50 and 80 bar g.

The R-2 reactor is dedicated for generating Alkyl benzenes boiling below 200° C. Most preferably, the R-2 reactor is dedicated for generating Alkyl benzenes boiling below 180° C. The primary reaction in R-2 is ring opening reaction and converting different types of benzo-cyclo-paraffin molecules to Alkyl benzenes. Another important reaction is hydrocracking of long aliphatic side chains of mono-aromatic molecule, those are especially present in the thermally cracked middle distillates, to alkyl benzenes boiling below 200° C. Most preferably, hydrocracking of long aliphatic side chains of mono-aromatic molecule, those are especially present in the thermally cracked middle distillates, to alkyl benzenes boiling below 180° C. The other hydroprocessing/hydrocracking reactions also occur in parallel with the reactions mentioned above.

The temperature in R-2 is maintained between 350 and 450° C. More preferably the temperature in R-2 is maintained between 370 and 420° C. Most preferably the temperature in R-2 is maintained between 380 and 410° C. The Linear Hourly Space Velocity (LHSV) is maintained between 0.2 and 2.0. Most preferably the Linear Hourly Space Velocity (LHSV) is between 0.2 and 1.5. The R-2 pressure is also very critical. The preferred pressure for this process is between 25 and 100 bar g. More preferably pressure for this process is between 35 and 90 bar g. Further most preferably pressure for this process is between 40 and 80 bar g.

In one of the features, it is further disclosed that, the R-1 and R-2 reactors can be operated either at same or different pressure. If the reactors are operated at different pressures, an intermediate separator between the two reactors may be provided. This will further enhance the reactivity of R-2 reactor and the operating parameters are adjusted accordingly. The two stage system is required particularly for those feed cases where N-content is high and the N-compounds are refractory at low pressure.

In yet another feature, it is further disclosed that the conversion of linear aliphatic hydrocarbon in R-2 is preferably less than 50 wt %. More preferably the conversion of linear aliphatic hydrocarbon in R-2 is less than 30 wt %. Most preferably the conversion of linear aliphatic hydrocarbon in R-2 is less than 20 wt %.

In yet another feature, it is further disclosed that the low boiling hydrocarbons with FBP below, 95° C. formed in the R-2 reactor are mostly iso-paraffins. More preferably the low boiling hydrocarbons with FBP is below 85° C. formed in the R-2 reactor are mostly iso-paraffins. Most preferably, the low boiling hydrocarbons with FBP is below 65° C. formed in the R-2 reactor are mostly iso-paraffins. The composition and physical property of Cut-1 does not alter significantly with the change in proportion of thermally cracked middle distillate in the feed.

In one feature, it is further disclosed that the Cut-2, Heavy Naphtha with high aromatics content can be also used as gasoline pool blending component.

TABLE 1

Characterization of middle distillates obtained from catalytic and thermal cracking

| Attributes | Middle distillate of Catalytic cracking units | Middle distillate of Thermal cracking units |
|---|---|---|
| Sulphur (wt %) | 1.0-1.5 | 0.5-1.50 |
| Nitrogen (ppm) | 100-800 | 500-1500 |
| Density @ 15° C. (g/cc) | 0.90-1.0 | 0.86-0.89 |
| Distillation (wt %) | Temperature (° C.) | |
| 5 | 200 | 259 |
| 30 | 252 | 309 |
| 50 | 274 | 329 |
| 70 | 304 | 347 |
| 95 | 367 | 391 |
| 98 | 389 | 416 |
| Cetane Number | 15-25 | 40-45 |
| Mono Aromatics (wt %) | 20-30 | 10-20 |
| Di Aromatics (wt %) | 40-70 | 5-15 |
| PAH (wt %) | 3-10 | 5-15 |
| Total Aromatics (wt %) | 65-90 | 20-50 |

Illustrative Example

Pilot plant experiment conducted with two feed streams. Feed-1 is LCO, obtained from a RFCC unit and Feed-2 is CGO obtained from a Delayed Coker unit. The characterization for Feed-1 and 2 are given below in Table-2.

TABLE 2

Feed Properties

| Attributes | Feed-1 (LCO) | Feed-2 (CGO) |
|---|---|---|
| Specific Gravity at 15° C., IS:1448-P:32 | 0.9897 | 0.8650 |
| Total Sulphur (ASTM D2622), wt % | 0.42 | 1.50 |
| Total Nitrogen (ASTM D4629), ppmw | 431 | 855 |
| Distillation, D-2887, wt % | ° C. | |
| 5 | 203 | 215 |
| 50 | 274 | 285 |
| 90 | 348 | 353 |
| 95 | 376 | 369 |
| Aromatics by HPLC | wt % | |
| Saturates | 10.1 | 68.8 |
| Mono-aromatics | 12.1 | 15.0 |
| Di aromatics | 66.5 | 12.7 |

TABLE 2-continued

Feed Properties

| Attributes | Feed-1 (LCO) | Feed-2 (CGO) |
|---|---|---|
| PAH | 11.3 | 3.5 |
| Cetane Number (ASTM D 613) | <25 | 43 |

Example 1

The feed stream consisting of 100% Feed-1 (LCO) is subjected to hydrotreatment and then hydrocracked. The hydrotreating and hydrocracking reactors operated at 370° C. and 390° C. WABT respectively, at a particular LHSV, pressure and $H_2$/HC ratio. The hydrocracker reactor outlet product fractionated and 3 cuts (Cut-1 (MP, 65° C.), Cut-2 (65-200° C.) and Cut-3 (200° C.+)) generated. The characterizations of the reactor outlet product and the cuts (3nos) are given below Table 3 and 4 respectively.

TABLE 3

Product Properties

| Attributes | Values |
|---|---|
| Specific Gravity at 15° C., IS:1448-P:32 | 0.8074 |
| Total Sulphur (ASTM D2622), ppmw | 19 |
| Total Nitrogen (ASTM D4629), ppmw | 1 |
| Distillation, D-2887, wt % | ° C. |
| 5 | 35 |
| 30 | 118 |
| 50 | 172 |
| 70 | 237 |
| 95 | 345 |
| Aromatics | wt % |
| Saturates | 27.5 |
| Monoaromatics | 49.9 |
| Di aromatics | 19.5 |
| Polyaromatics | 3.1 |

TABLE 4

Properties of the cuts

| Attributes | Cut-1 (IBP-65° C.) | Cut-2 (65-200° C.) | Cut-3 (200° C.+) |
|---|---|---|---|
| Specific Gravity at 15° C., IS:1448-P:32 | 0.6528 | 0.8287 | 0.8844 |
| Total Sulphur (ASTM D2622), ppmw | 5 | 6 | 8 |
| Total Nitrogen (ASTM D4629), ppmw | <1 | <1 | <1 |
| Distillation, D-2887, wt % | ° C. | ° C. | ° C. |
| IBP | 20 | 38 | 183 |
| 5 | 22 | 74 | 198 |
| 30 | 31 | 109 | 220 |
| 50 | 51 | 130 | 238 |
| 70 | 56 | 142 | 270 |
| 95 | 79 | 185 | 348 |
| RON (ASTM D2699) | 90.0 | 96.2 | NA |
| Cetane Number (ASTM D 613) | NA | NA | 35 |

Example 2

The feed stream consisting of 85 wt % Feed-1 (LCO) & 15 wt % (CGO) is subjected to hydrotreatment and then hydrocracked. The hydrotreating and hydrocracking reactors operated at 370° C. and 390° C. WABT respectively, at a particular LHSV, pressure and $H_2$/HC ratio. The hydrocracker reactor outlet product fractionated and 3 cuts generated. This example shows that with blending of 15% CGO, thermally cracked middle distillate (MD) into the feed LCO, MD of catalytic cracker improves the cetane number of the unconverted (UCO) stream. More particularly, this example indicates that when the LCO feed is 100% (example-1), the Cetane number of Cut-3 is only 35. However, on blending of 15% CGO (example-2) in the feed, the cetane number of the UCO stream (Cut-3) improves to 53. The characterizations of the reactor outlet product and the cuts (3nos) are given below Tables 5 and 6 respectively.

TABLE 5

| Product properties | |
|---|---|
| Attributes | Values |
| Specific Gravity at 15° C., IS:1448-P:32 | 0.7887 |
| Product Sulphur, (ASTM D5453), ppmw | 23 |
| Product Nitrogen, (ASTM D4629) ppmw | 1.4 |
| Distillation, D-2887, wt % | ° C. |
| 5 | 9 |
| 30 | 54 |
| 50 | 106 |
| 70 | 140 |
| 95 | 299 |
| Aromatics | wt % |
| Saturates | 46 |
| Monoaromatics | 46.4 |
| Di aromatics | 6.7 |
| PAH | 1 |

TABLE 6

| Properties of the cuts | | | |
|---|---|---|---|
| Attributes | Cut-1 (IBP-65° C.) | Cut-2 (65-200° C.) | Cut-3 (200° C.+) |
| Specific Gravity at 15° C., IS:1448-P:32 | 0.6528 | 0.8287 | 0.8844 |
| Total Sulphur (ASTM D2622), ppmw | 3 | 6.4 | 8.9 |
| Total Nitrogen (ASTM D4629), ppmw | <1 | <1 | <1 |
| Distillation, D-2887, wt % | ° C. | ° C. | ° C. |
| IBP | 20 | 38 | 183 |
| 5 | 22 | 74 | 198 |
| 30 | 31 | 109 | 220 |
| 50 | 51 | 130 | 238 |
| 70 | 56 | 142 | 270 |
| 95 | 79 | 185 | 348 |
| RON (ASTM D2699) | 89.2 | 94.1 | NA |
| Cetane Number (ASTM D 613) | NA | NA | 53 |

Example 3

The feed stream consisting of 65 wt % Feed-1 (LCO) & 35 wt % (CGO) is subjected to hydrotreat and then hydrocracked. The hydrotreating and hydrocracking reactors operated at 370° C. and 390° C. WABT respectively, at a particular LHSV, pressure and $H_2$/HC ratio. The hydrocracker reactor outlet product fractionated and 3 cuts generated. The RON of Cut-1 and Cut-2 are 87.5 and 89.5 respectively, however, the cetane number of Cut-3 is 55. This example shows that if the percentage of thermally cracked feed is increased beyond a certain limit the aromatic concentration in the Cut-2 is reduced substantially and this can be observed through reduction in RON value.

Advantages of the Present Invention

Improvement of Cetane number of the unconverted stream (IBP: 200° C.+) generated in the processes while upgrading high aromatic middle distillate range boiling streams (LCO) to (i) High-Octane gasoline blending stream, (ii) Heavy Naphtha with high-aromatic content, feedstock for BTX production.

Cetane number of the unconverted stream is improved by change in feed composition without hampering the properties of (i) High-Octane gasoline blending stream, (ii) Heavy Naphtha with high-aromatic content, feedstock for BTX production.

The invention claimed is:

1. A process for production of High-Octane Gasoline blending component, Heavy Naphtha with high aromatic content and High Cetane Diesel from high aromatic middle distillate range boiling streams, the process consisting of the steps of:

(a) subjecting a combined feed-1 and feed-2 to a hydrotreating step at a predetermined pressure to obtain a first effluent having removed heteroatom, wherein the pressure is capable of saturating of only one ring of multi-ring aromatics, wherein the hydrotreating step is carried out at a pressure of 25 to 100 bar g and temperature of 320 to 410 ° C. and at a LHSV of 0.5 to 1.5 $h^{-1}$;

(b) subjecting the first effluent to a hydrocracking step to obtain a second effluent, wherein the hydrocracking is operated for selective opening of saturated ring of the multi-ring aromatics and hydrocracking of long aliphatic side chains of mono-aromatic molecule present in the first effluent, wherein the hydrocracking step is carried out at conversion level that gives combined yield of first and second products, wherein the first product is high in octane gasoline and the second product is high in aromatic naphtha above 30 wt %, wherein the hydrocracking step is carried out at a pressure of 25 to 100 bar g, and at a temperature of 350 to 450 ° C. and at a LHSV of 0.2 to 2.0 $h^{-1}$;

(c) fractionating the second effluent into a CUT-1, a CUT-2 and a CUT-3; wherein:

the CUT-1 is having boiling point between 35 and 95° C., which is High-Octane gasoline blending component having octane number greater than 88;

the Cut-2 is having a boiling point between 95 and 210° C., which is Heavy Naphtha with high aromatic content and alkylated monoaromatics concentration more than 50 wt %; and the Cut-3 is having boiling point above 210° C. which is High Cetane Diesel having cetane number more than 50 and comprising an enhanced concentration of saturates, wherein the process further comprising recycling a part of the high cetane diesel of step (c) to step (a);

wherein the feed-1 is middle distillate boiling range stream obtained from catalytic cracking unit, and feed-2 is middle distillate boiling range stream obtained from thermal cracking unit and the feed 2 having thermally cracked unit is present in the combined feed is in the range of 5 to 30 wt %;

wherein the combined feed contains at least 30 wt % of two or more ring aromatics content therein and boiling point between 140 to 430° C.;

wherein the combined feed is the mixture of feed-1 and feed-2 in the ratio from 95:5 to 70:30 by mass;

wherein the thermal cracking unit is selected from Delayed Coker Unit (DCU) and visbreaker unit.

2. The process as claimed in claim 1, wherein the High Cetane Diesel contains cetane number more than 51.

* * * * *